US006966534B2

(12) United States Patent
Kamenstein et al.

(10) Patent No.: US 6,966,534 B2
(45) Date of Patent: Nov. 22, 2005

(54) WIRE SYSTEM FOR HANGING PICTURE FRAMES

(76) Inventors: Peter Kamenstein, 665 Titicus Rd., North Salem, NY (US) 10560; Joseph P. Opramolla, 173 Middle Winchendon Rd., Rindge, NH (US) 03461; Robert Howitt, 20 Wachusett St., Leominster, MA (US) 01453

( * ) Notice: Subject to any disclaimer, the term of this patent is extended or adjusted under 35 U.S.C. 154(b) by 24 days.

(21) Appl. No.: 10/429,300

(22) Filed: May 5, 2003

(65) Prior Publication Data

US 2004/0035999 A1 Feb. 26, 2004

Related U.S. Application Data

(60) Provisional application No. 60/405,224, filed on Aug. 22, 2002.

(51) Int. Cl.[7] ..... A47G 1/18

(52) U.S. Cl. ..... 248/493; 248/475.1; 188/65.1; 24/132 R; 24/132 AA; 24/134 P

(58) Field of Search ..... 248/475.1, 489, 248/492, 493, 495, 63; 188/65.1, 65.3, 65.4; 24/129 A, 132 AA, 132 WL, 133, 134 KA, 24/134 KB, 134 L, 134 N, 134 P, 134 R, 24/132 R; 40/757; 182/235

(56) References Cited

U.S. PATENT DOCUMENTS

| | | | | | |
|---|---|---|---|---|---|
| 836,303 | A * | 11/1906 | Christensen | 188/67 |
| 924,853 | A * | 6/1909 | Sweetland | 292/306 |
| 1,057,484 | A * | 4/1913 | Huber | 24/135 N |
| 1,222,530 | A * | 4/1917 | Cook | 248/493 |
| 2,315,196 | A * | 3/1943 | Gallione | 248/499 |
| 2,965,940 | A * | 12/1960 | Willits | 24/132 R |
| 3,958,784 | A * | 5/1976 | Bourrieres | 248/63 |
| 4,399,889 | A * | 8/1983 | Todd | 182/6 |
| 4,413,382 | A * | 11/1983 | Siegmann | 24/132 R |
| 4,450,603 | A * | 5/1984 | Hirsch | 24/132 R |
| 4,477,947 | A * | 10/1984 | Lyons | 24/115 F |
| 4,591,021 | A * | 5/1986 | Lew et al. | 182/10 |
| 4,817,250 | A * | 4/1989 | Kurosaki | 24/115 G |
| 6,601,649 | B2 * | 8/2003 | Beato et al. | 166/352 |

FOREIGN PATENT DOCUMENTS

| | | | | |
|---|---|---|---|---|
| FR | 2623073 A1 * | 5/1989 | | 248/489 |
| GB | 2210517 A * | 6/1989 | | 24/134 R |

* cited by examiner

*Primary Examiner*—Jonathon Szumny
(74) *Attorney, Agent, or Firm*—Mark Montague, Esq.; Cowan, Liebowitz & Latman

(57) ABSTRACT

A wire system for use with picture frames and other items to be hung from or mounted to a vertical support. The wire system includes a base that includes a plurality of openings and rotatable levers that include respective internal passageways. Wire is installed through the various openings and the internal passageways of the levers in a manner where rotation of the levers causes the wire to be bent at various locations. With the wires appropriately bent, the wire is secured within the wire system. To adjust the wire, the levers are rotated to their respective open positions to unbend the wire thus allowing it to be freely movable within the wire system. Generally, the wire system is for use on the back of picture frames and other items to be hung from a wall, where the wire system enables a user to easily tighten or loosen the wire in a simple manner.

5 Claims, 3 Drawing Sheets

WIRE SYSTEM FOR HANGING PICTURE FRAMES

REFERENCE TO RELATED APPLICATION

This application claims the benefit of U.S. Provisional Patent Application Ser. No. 60/405,224, filed Aug. 22, 2002, the disclosure of which is incorporated herein by reference.

FIELD OF THE INVENTION

The present invention relates to a wire system for hanging picture frames and the like and, more particularly, to a device that secures wire on picture frames and other items to be mounted on a vertical support.

BACKGROUND OF THE INVENTION

Wire secured to and extending across the back of a picture frame (i.e., picture frame wire or wire, as used herein) is utilized to allow for the easy hanging of that picture frame on an appropriate nail, picture frame hanger or other item protruding from a wall or other vertical surface. Wire is secured to picture frames utilizing staples or by feeding the wire through eye hooks screwed into the picture frame and then wrapping the wire around itself.

Devices that are more modern are available but generally require that the wire be wrapped around itself to secure it, which in turn requires that the wire be unwrapped or unwound should it be necessary to tighten or loosen the wire.

OBJECTS OF THE INVENTION

Therefore, it is an object of the present invention to provide a wire system (also called wiring device herein) that is easy to use and, at the same time, overcomes the above-mentioned shortcoming associated with standard wiring methods.

It is a further object of the present invention to provide a wire system that allows for the quick and easy securing of wire onto the back of a picture frame or other object to be hung on a wall or other vertical support.

It is another object of the present invention to provide a wire system that can quickly and easily tighten (or loosen) the wire.

Various other objects, advantages and features of the present invention will become readily apparent to those of ordinary skill in the art, and the novel features will be particularly pointed out in the appended claims.

SUMMARY OF THE INVENTION

In accordance with the present invention, an assembly for retaining wire for use with a picture frame and other objects to be mounted to a vertical support includes a base and one or more movable levers mounted to the base. The lever includes a passageway, through which wire may be fed, and the lever is movable between open and closed positions, wherein the assembly securely retains the wire when the lever is in the closed position, and does not securely retains the wire when the lever is in the open position.

As an aspect of the invention, the lever is rotatably movable relative to the base.

As another aspect of the invention, the assembly may further include a second lever through which the wire extends.

As a further aspect of the invention, the assembly includes a locking mechanism that is coupled to the lever for selectively locking the lever in the closed position.

As an additional aspect of the invention, the wire is bent in one or more positions when the lever is moved to the closed position so as to sufficiently retain the wire within the assembly.

BRIEF DESCRIPTION OF THE DRAWINGS

The following detailed description, given by way of example and not intended to limit the present invention solely thereto, will best be appreciated in conjunction with the accompanying drawings, wherein like reference numerals denote like elements and parts, in which.

DETAILED DESCRIPTION OF THE INVENTION

Figure 1:
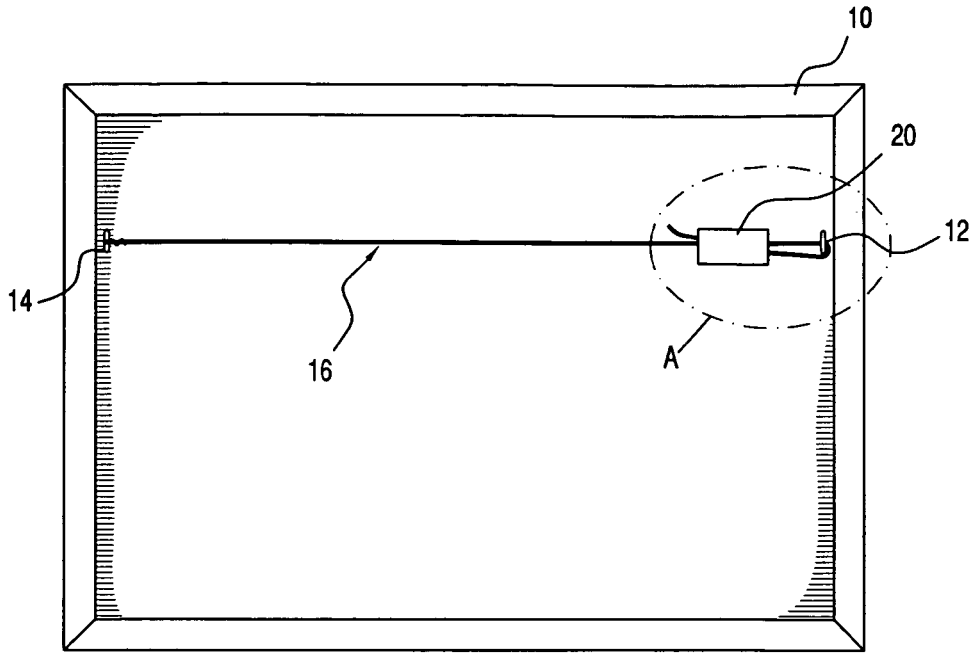
FIG. 1 is a schematic illustration of the wire system of the present invention, in use with a picture frame.

Referring now to the drawings, FIG. 1 is a schematic illustration broadly showing how the wire system of the present invention is utilized. FIG. 1 schematically shows the back of a picture frame 10, a pair of eye hooks 12 and 14 that are screwed into the back of the picture frame on opposite ends, as shown, and wire 16. Of course, eye hooks 12 and 14 may be replaced with other suitable devices known in the art that are mounted in any suitable manner to the back, sides or top of a picture frame (or other item to be mounted on a wall or vertical support).

FIG. 1 also shows a wire system 20 in accordance with the present invention. Wire system 20 (also called wiring device herein) is utilized to provide various advantageous features, as further discussed below. Although FIG. 1 shows the use of only a single wire system 20, two wire systems may be utilized on a single picture frame. In such case, one wire system is disposed adjacent to or near one of the eye hooks (e.g., eye hook 12) and a second wire system is disposed near the other eye hook (e.g., eye hook 14). If only a single wire system is utilized, it is preferred that the wire system be disposed near one of the eye hooks, such as shown in FIG. 1, where wire 16 is secured near that eye hook in the manner described herein and wherein the other end of wire 16 is secured to the other eye hook (e.g., eye hook 14) in any manner known in the art. Of course, wire system 20 may be disposed at any location between the two eye hooks.

If two wire systems are utilized, then each end of wire 16 is secured in accordance with the present invention, thus fully obviating the need to wrap the wire around itself. Securing of the wire utilizing wire system 20 of the present invention is further discussed below.

Figure 2:
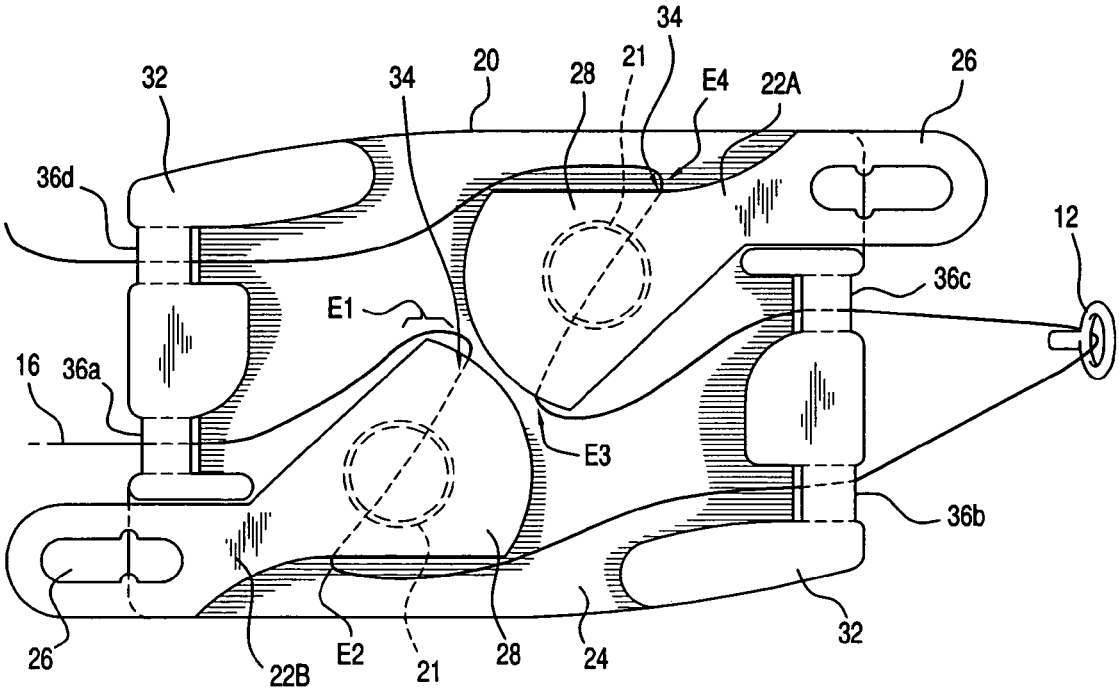
FIG. 2 is an enlarged view of the wire system of the present invention.
Figure 3:
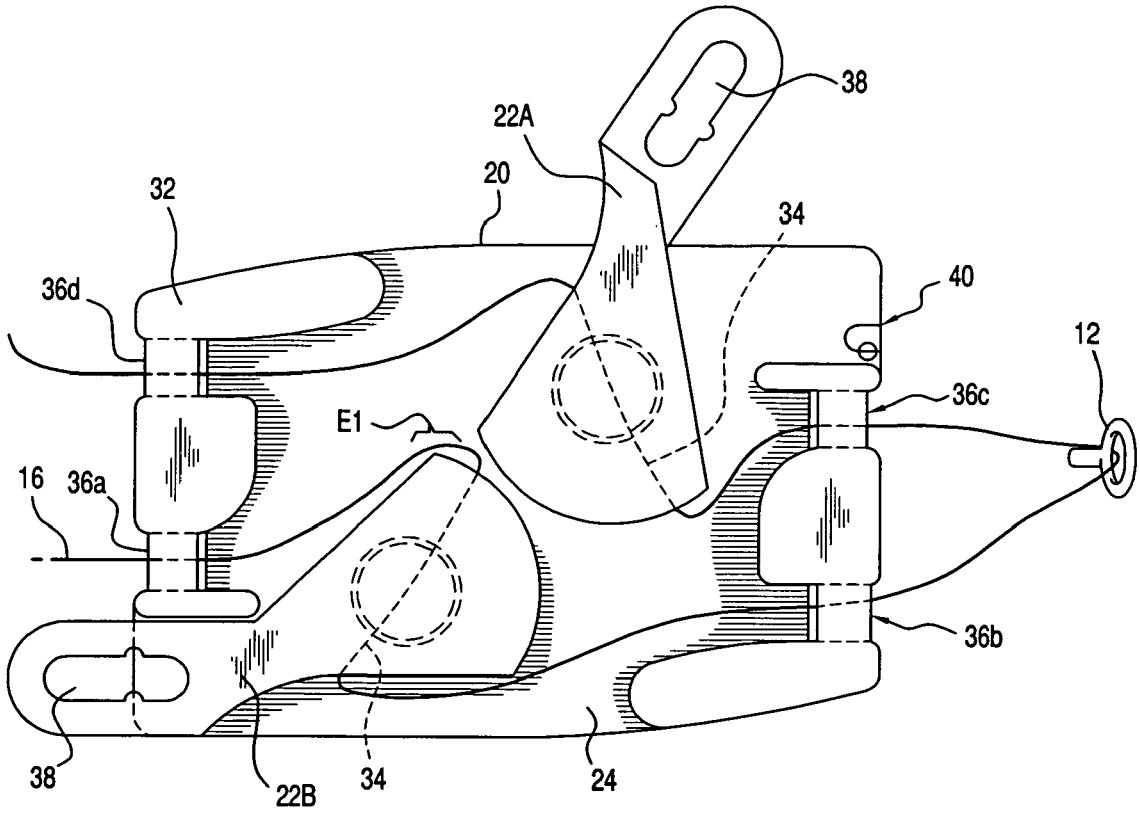
FIG. 3 is another enlarged view of the wire system of the present invention, shown in a partially open position.

Referring now to FIGS. 2 and 3 of the drawings, FIG. 2 shows wire system 20 in its closed position and FIG. 3 shows the wire system in a partially open position. FIG. 2 shows an enlarged view of portion "A" shown in FIG. 1. As shown, a portion of wire 16 extends through wire system 20, then through eye hook 12, back through wire system 20 and then terminating in a manner well known in the art. Wire system 20, in accordance with the present invention, includes two rotatable levers 22A and 22B. In the positions shown in FIG. 2 (i.e., the closed position), levers 22A and 22B serve to secure the wire. When wire system 20 is made of a suitably strong material, and levers 22A and 22B are locked (further discussed below), the device of the present invention sufficiently maintains wire 16 so that the wire system of the present invention may be used with picture frames and other items to be hung that are quite heavy. Of course, smaller, less strong wire systems can be manufactured and used for relatively light picture frames, whereas bigger, stronger wire systems may be manufactured and used for relatively heavy picture frames (e.g., weighing 100 lbs. or more). Given the description herein, selection of materials and dimensions for the wire system of the present invention is well within the ability of a person of ordinary skill in the art and, thus, further discussion of strengths and dimensions are not provided herein.

Wire system 20 includes a body 24 on which levers 22A and 22B are rotatably mounted. Each lever 22A and 22B includes a respective handle portion 26 and a respective central body portion 28. The wire system's body 24 includes two sets of circular protrusions 21 (shown in phantom) that extend from the flat surface of body 24 and corresponding recesses within levers 22A and 22B operate to interact with the circular protrusions so that levers 22A and 22B are secured to and rotatable on the wire system's body 24. However, the particular manner in which levers 22A and 22B are rotatably mounted to body 24 is not critical to the present invention and such rotatable mounting may be achieved in any manner well known in the art.

The wire system's body 24 also includes a number of protruding walls 32 that serve at least three functions, as follows. First, walls 32 include a number of openings 36A, 36B, 36C, 36D, as shown in FIG. 2, that are used to direct the wire through the wire system 20 of the present invention, as further discussed below. Second, a couple of portions of the walls serve to limit rotational movement of levers 22A, 22B. Third, the depth of walls 32 along with levers 22A and 22B, define a recessed region in which wire is disposed. Thus, wire does not constantly rub against a wall or the picture frame itself during use of the wire system of the present invention.

Each lever 22A and 22B includes a respective tunnel or a passageway 34, represented by dashed lines in FIG. 2, through which wire 16 extends.

Following wire 16, originating from eye hook 14 (not shown in FIG. 2), the wire extends first though opening 36A of wall 32. Wire 16 then extends through passageway 34 within lever 22B, and then extends through opening 36B within wall 32. Wire 16 then extends away from the wire system 20 of the present invention and through eye hook 12, as shown, and then back through another opening—opening 36C. The wire then extends though passageway 34 of rotatable lever 22A, then through opening 36D within wall 32.

When levers 22A and 22B are in their "closed" positions, as shown in FIG. 2, wire 16 is held taut by the wiring system of the present invention, primarily due to the forced bending of the wire at various points by the use of levers 22A and 22B and the placement of openings 36A, 36B, 36C and 36D. As shown in FIG. 2, wire 16 is bent at four locations E1, E2, E3 and E4. Each bending of the wire is sufficient to prevent wire movement due to the physical characteristics of most types of picture frame and other types of hanging wire. As shown, the wire is bent more than 90 degrees. Even greater bending angles provide greater securing of the wire and, thus, levers that accomplish even greater bending may be utilized.

Turning now to FIG. 3, lever 22A is shown in its "open" position. Although not shown in the drawings, lever 22B similarly may be placed in its open position via rotation relative to the wire system's body 24. During initial installation of wire system 20 of the present invention, where wire system 20 typically will be purchased or otherwise provided without wire extending through it, levers 22A and 22B are rotated to their respectively open positions. One end of suitable picture frame wire is fed through each of the openings and passageways of the wire system to follow the path shown. Since levers 22A and 22B are in their open position (lever 22B not shown in the open position in FIG. 3), wire is easily fed through wire system 20. As is clear from the drawings, wire initially is fed through opening 36A, then through passageway 34 of lever 22B, then through opening 36B, then around eye hook 12 (or other equivalent component mounted to the back of the picture frame), then back to wire system 20 through opening 36C, then through passageway 34 of lever 22A, and finally through opening 36D. The wire then may be terminated around eye hook 14 (e.g., by wrapping the wire around itself after having passed through eye hook 14) or by use of another suitable termination device or technique or by use of another wire system in accordance with the present invention, as previously mentioned. Generally, after the wire is sufficiently terminated, it should not be taut, as would be well known to those of ordinary skill in the art. Then, to close the wire system of the present invention, both levers 22A and 22B are rotated to their respective closed position—to the positions shown in FIG. 2. As previously discussed, the forced bending of the wire at various positions, such as shown in FIG. 2, provides a securing of the wire within wire system 20.

To modify the length of wire after it has been installed on the back of a picture frame by use of wire system 20 of the present invention, the wire may be loosened or tightened, as herein described. One or both levers 22A and 22B may be opened, and with a lever open, wire 16 is allowed to be moved so as to tighten or loosen it, as would be appropriate. After such movement, the opened lever or levers 22A and/or 22B are rotated to their final, closed position.

Figure 4:
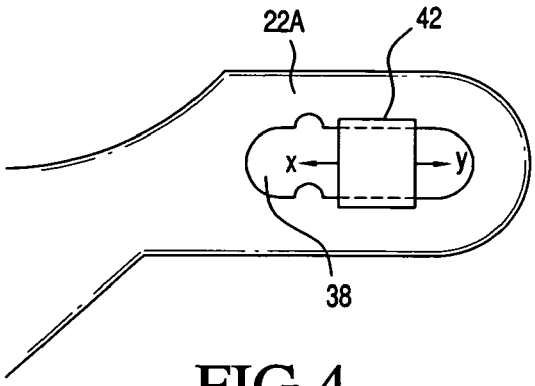
FIG. 4 is a schematic illustration of the wire system's locking mechanism in accordance with the present invention.

As previously mentioned, each of the levers 22A and 22B can be locked in their respective closed position. Locking is facilitated by a pair of recesses 40 (only one recess 40 shown in FIG. 3). Each lever 22A and 22B includes an aperture 38 through which a locking mechanism 42, schematically shown in FIG. 4, is disposed. Locking mechanism 42 disposed through aperture 38 is movable along one axis. Locking mechanism 42 may be moved in directions x and y, shown in FIG. 4. When lever 22 is in its closed position, and when locking mechanism 42 is moved in direction x, an appropriately sized portion of locking mechanism 42 becomes disposed within recess 40 (shown in FIG. 3). The various components are suitably sized so that a slight amount of force is required to lock lever 22A (as well as lever 22B), so that it does not become unlocked by simple movement or shaking of wire system 20 of the present invention. Other forms of appropriate locking mechanisms may be utilized, as would be known within the art. For example, locking pins may be installed within suitably sized holes disposed within levers 22A and 22B and the body of the wire system, where unlocking requires removal of the pins. Wingnuts and other similar devices likewise may be utilized. Thus, the specific manner of locking may be accomplished by any suitable means which accomplishes this function.

Figure 5:
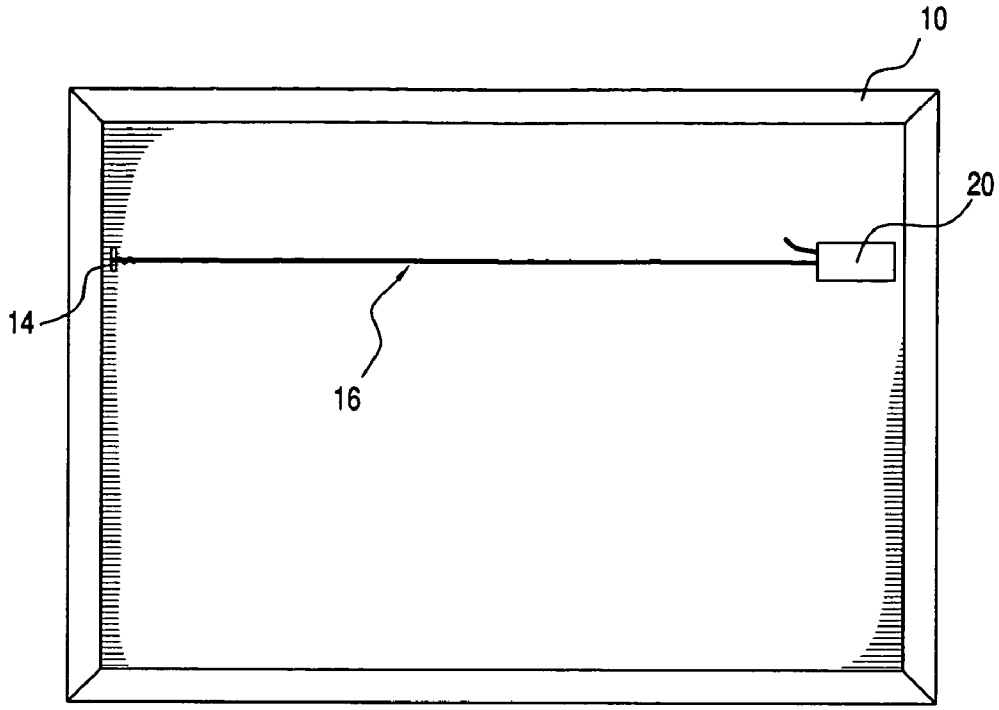
FIG. 5 is a schematic illustration of the wire system mounted to a picture frame.
Figure 6:
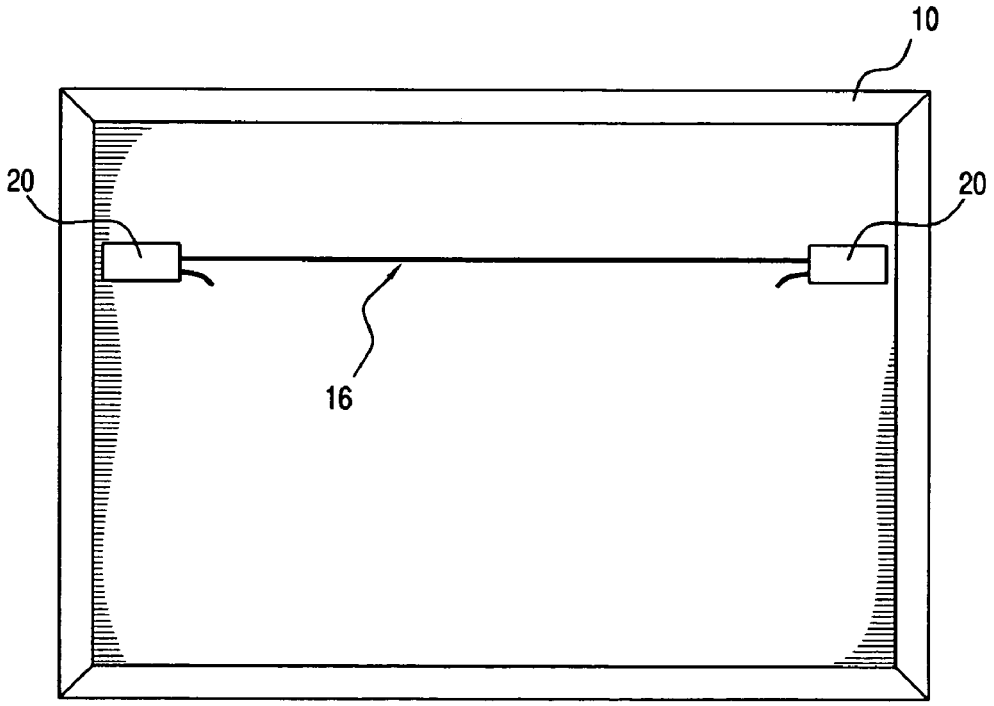
FIG. 6 is a schematic illustration of two wire systems mounted to a picture frame in accordance with the present invention.

In accordance with another variation of the present invention, wire system 20 may be mounted (i.e., fixed) to the back (or side, top, etc.) of picture frame 10 or other object to be mounted to a vertical support. As shown in FIG. 5, wire system 20 is fixed to one side of the back of picture frame 10 in any suitable method, such as by use of a screw, bolt or other known device. In such case, the use of an eye hook adjacent to the wire system is not needed, since the wire system itself serves both to firmly retain the wire and to retain such wire to the picture frame. Two wire systems may also be utilized in this manner, as shown in FIG. 6. As shown, the left side of the back of the picture frame 10 includes a first mounted wire system 20 and the right side of the back of the picture frame includes a second mounted wire system 20. In such case, no eye hook is needed, nor any other mechanism for mounting wire to the picture frame, including staples or other known devices.

The present invention has been described with reference to specific designs and description, as provided above. However it is appreciated that various other designs may be provided. For example, while the disclosed wire system is shown as including two rotatable levers, and four openings within body 24 of wire system 20, other numbers of levers and/or openings may be provided. Perhaps to accommodate substantially heavier picture frames, three (or more) rotatable levers may be provided. As another example, the design described shows levers 22A and 22B that rotate in opposite directions. However, both levers may rotate in the same directions, and/or may be placed on the same side (e.g., left side) of the wire system. As a further example, levers 22*a* and 22*b* may move from their respective open position to closed position in a different manner, including, but not limited to, movement along a single axis.

Therefore, it is intended that the appended claims be interpreted as including the embodiments described herein, the alternatives mentioned above, and all equivalents thereto.

What is claimed is:

1. A method of securing wire at two portions of the wire, comprising the steps of:

providing an assembly having a base and first and second one-piece levers movably secured to the base;

disposing a first portion of the wire through a first opening in the base, then through an internal passageway in the first lever, then through a second opening in the base, wherein the first and second openings are disposed on substantially opposite ends of the base;

disposing a second portion of the wire through a third opening in the base, then through an internal passageway in the second lever, then through a fourth opening in the base, wherein the third and fourth openings are disposed on substantially opposite ends of the base;

pivoting the first lever relative to the base to cause the first portion of the wire to be substantially bent between the first and second openings in the base; and pivoting the second lever relative to the base to cause the second portion of the wire to be substantially bent between the third and fourth openings in the base.

2. The method of claim 1, wherein the step of moving the first lever causes the first portion of the wire to be substantially bent at two places between the first and second openings in the base.

3. The method of claim 1, wherein the step of moving the first lever is carried out by rotating the first lever from an open position to a closed position.

4. The method of claim 3, further comprising the step of rotating the first lever from the closed position to the open position to cause the bent portion of the wire between the first and second openings in the base to unbend sufficiently to allow the wire to be substantially movable through the internal passageway of the first lever.

5. A combination, comprising:

an object to be hung from a substantially vertical surface;

a first assembly secured to the object and including a base and a lever movably secured to the base, the lever having an internal passageway and being movable relative to the base between an open position and a closed position;

wire having a portion disposed within the internal passageway of the lever of the first assembly;

the first assembly being adapted to bend a portion of the wire at least 90 degrees so as to securely retain the wire when the lever is moved to the closed position and to sufficiently unbend the portion of the wire so as to not securely retain the wire when the lever is moved to the open position;

the object including left and right portions and the first assembly being secured to the object at the left portion;

a second assembly secured to the fight portion of the object and including a respective base and a respective lever movably secured to the base, the respective lever having an internal passageway and being movable relative to the base between an open position and a closed position;

the wire including first and second ends, the first end being secured by the first assembly and the second end being secured by the second assembly.

* * * * *